US006343962B2

(12) United States Patent
Krause

(10) Patent No.: US 6,343,962 B2
(45) Date of Patent: Feb. 5, 2002

(54) CABLE LUG WITH A DEFINED CONTACT SURFACE

(75) Inventor: Jens Krause, Rahden (DE)

(73) Assignee: Harting Automotive GmbH & Co., KG, Espelkamp (DE)

( * ) Notice: Subject to any disclaimer, the term of this patent is extended or adjusted under 35 U.S.C. 154(b) by 0 days.

(21) Appl. No.: 09/760,918

(22) Filed: Jan. 16, 2001

(30) Foreign Application Priority Data

Jan. 17, 2000 (DE) ..... 100 01 630

(51) Int. Cl.[7] ..... H01R 4/30
(52) U.S. Cl. ..... 439/801; 439/883; 439/886
(58) Field of Search ..... 439/801, 882, 439/883, 868, 886

(56) References Cited

U.S. PATENT DOCUMENTS

| | | | | |
|---|---|---|---|---|
| 3,626,357 A | | 12/1971 | Kindell et al. | |
| 3,861,595 A | | 1/1975 | Deal | |
| 4,983,133 A | * | 1/1991 | Van Scyoc et al. | 439/883 |
| 5,108,320 A | * | 4/1992 | Kimber | 439/801 |
| 5,188,544 A | * | 2/1993 | Mukai | 439/883 |
| 5,470,183 A | | 11/1995 | Swick | |
| 5,619,176 A | | 4/1997 | Hays | |
| 5,655,936 A | | 8/1997 | Meredith | |
| 5,672,442 A | | 9/1997 | Burnett | |
| 5,842,894 A | * | 12/1998 | Mehlberg | 439/801 |
| 5,934,923 A | * | 8/1999 | Matsuoka et al. | 439/883 |
| 6,089,930 A | * | 7/2000 | Matsuoka et al. | 439/886 |

FOREIGN PATENT DOCUMENTS

| | | | | |
|---|---|---|---|---|
| DE | 25 10 231 B2 | | 11/1975 | |
| DE | 36 24 938 C2 | | 1/1988 | |
| GB | 2183404 A | * | 6/1987 | 439/883 |

* cited by examiner

*Primary Examiner*—Tho D. Ta
(74) *Attorney, Agent, or Firm*—Cook, Alex, McFarron, Manzo, Cummings & Mehler, Ltd.

(57) ABSTRACT

The invention relates to a cable lug including a receiving section (12) for a cable and an attachment nut (16), wherein a defined contact area having a defined contact force exists between the cable lug (10) and a counter surface to be contacted. To this end, a contact section (14) is provided which is equipped with a bead which by means of the attachment nut (16) can be forced against a counter surface to be contacted.

6 Claims, 2 Drawing Sheets

CABLE LUG WITH A DEFINED CONTACT SURFACE

BACKGROUND OF THE INVENTION

The invention relates to a cable lug comprising a receiving section for a cable and an attachment nut.

In conventional cable lugs, a plane surface of the cable lug is forced by the attachment nut against a counter surface to be contacted. The force exerted by the attachment nut generates point contacts between cable lug and counter surface. The position of the point contacts and the pressure in the resulting contact areas are rather random and undefined, since they depend on the microscopic unevenness of the cable lug and the counter surface. In this connection, it is problematic that a specific minimum pressure must be observed between counter surface and cable lug to prevent the occurrence of corrosion at the contact points.

SUMMARY OF THE INVENTION

The object of the invention consists in further developing a cable lug of the initially mentioned type such that a defined contact surface and a defined contact pressure are ensured between this contact surface and the counter surface.

To this end, a contact section is provided at the contact lug, which is provided with a bead which by means of the attachment nut can be forced against a counter surface to be contacted. The bead forms an accurately defined contact surface which abuts against the counter surface. Since the dimensions of the contact surface are known, the operative contact pressure can also be adjusted by means of the contact force exerted by the contact nut such that corrosion phenomena cannot occur.

The bead is preferably annular and concentric with respect to the center axis of the attachment nut. This ensures a symmetrical, constant contact pressure between bead and counter surface. As an alternative, an oval or similar shape is also conceivable for the bead.

According to an alternative embodiment the bead is designed discontinuously. In this way, it acts additionally as a protection against rotation when it contacts the counter surface to be contacted.

According to the preferred embodiment it is provided that the bead has a contact surface facing the counter surface to be contacted. This contact surface extends in curved manner in a cross-section along a plane containing the center axis of the attachment nut. In this way, a line contact is initially obtained when the cable lug is put on the counter surface. Thus, already when the tightening of the attachment nut starts it is possible to locally obtain contact pressures which in the case of a possible unevenness are high enough to deform the material either plastically or elastically whereby a uniform contact between contact lug and counter surface is obtained.

According to the preferred embodiment of the invention it is provided that the bead is disposed radially outside the area within which the attachment nut abuts against the contact section. With this design, the contact section is biased like a Belleville spring when the attachment nut is tightened. This ensures that the contact pressure remains almost constant also over relatively long periods of time and in the case of possible settling actions.

The bead is preferably formed by embossing the contact section on its side facing away from the counter surface. This enables cost-effective production.

Advantageous embodiments of the invention follow from the subclaims.

BRIEF DESCRIPTION OF THE DRAWINGS

The invention is described below by means of a preferred embodiment which is illustrated in the appended drawings, in which.

DETAILED DESCRIPTION OF THE INVENTION

Cable lug 10 according to the invention has a receiving section 12 which is designed as a crimp section and is adapted to receive a cable to be connected (not shown). The cable lug also has a contact section 14 adapted to contact a counter surface (not shown) to be connected with the cable.

An attachment nut 16 is captively mounted on contact section 14. This nut serves for forcing the contact section against the counter surface by screwing the attachment nut onto a screw bolt.

Figure 1:
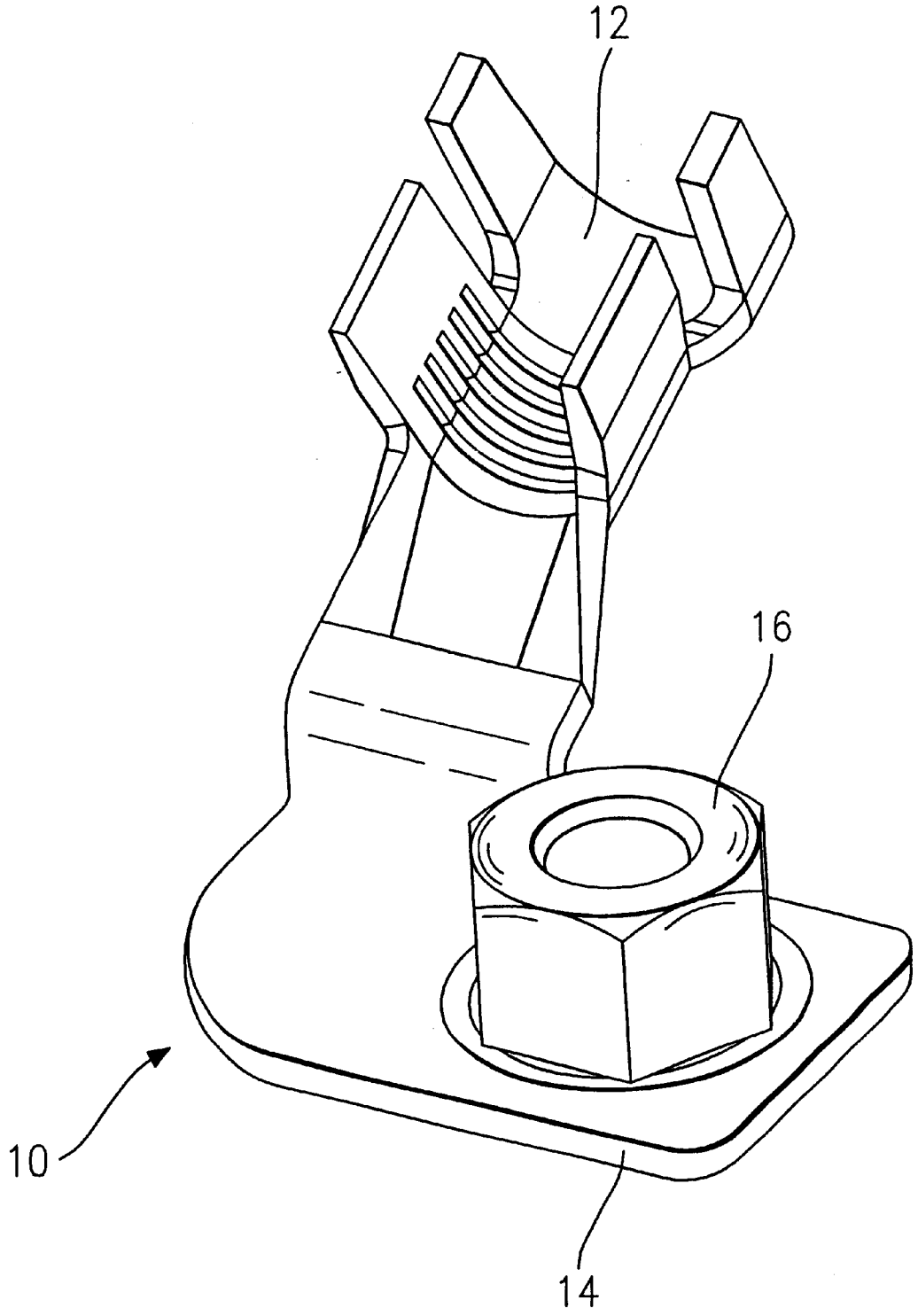
FIG. 1 shows a perspective view of a cable lug according to the invention.
Figure 2:
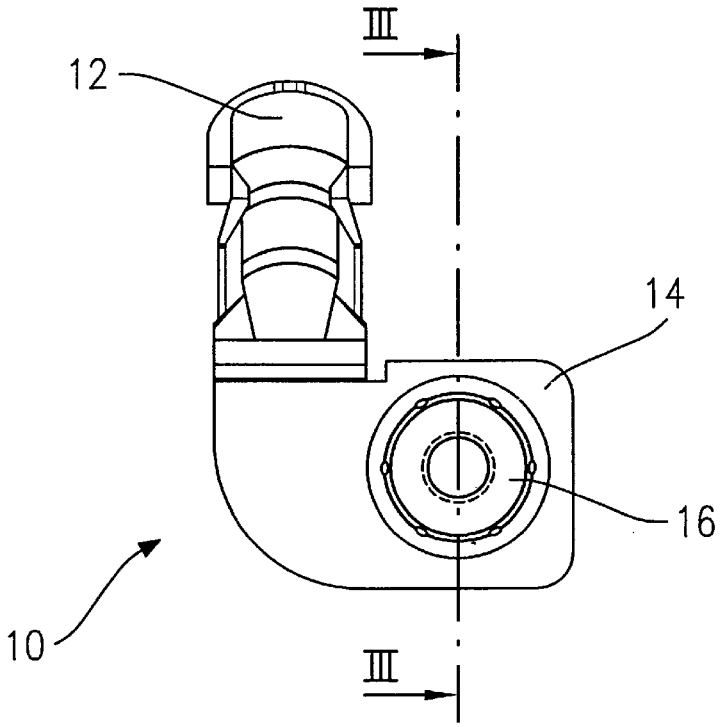
FIG. 2 shows a top view onto the cable lug of FIG. 1.
Figure 3:
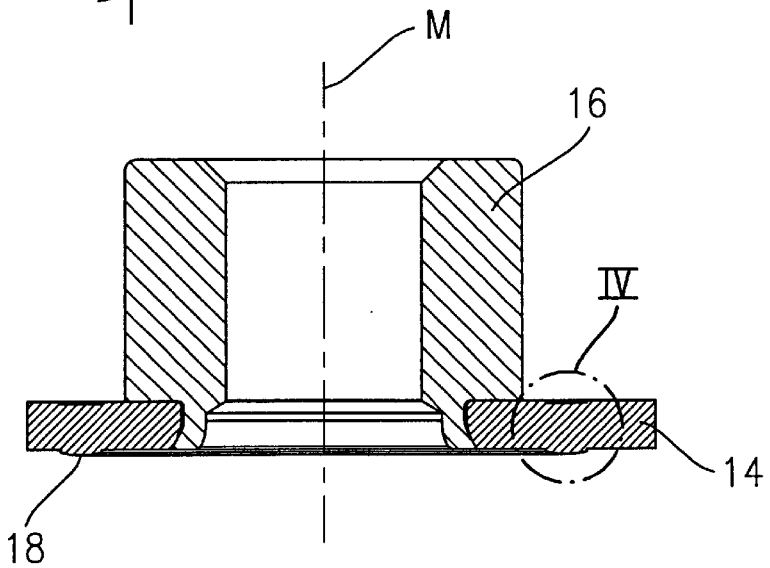
FIG. 3 shows an enlarged scale of a section along plane III—III of FIG. 2.
Figure 4:
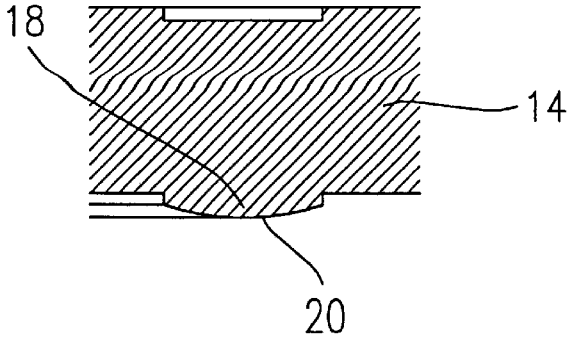
FIG. 4 shows a scale, enlarged a second time, of detail IV of FIG. 3.

A bead 18 is provided at the contact section 14 on the side facing away from the attachment nut. This bead is designed as a closed ring which is concentric with the center axis M of the attachment nut. On its side facing away from the attachment nut, the bead has a contact surface 20 which is designed in curved manner in a cross-section along a plane containing the center axis M (see FIG. 4).

The bead is obtained by embossing the contact section 14 on the side of the attachment nut. By a corresponding design of the embossing tool it is, in this connection, possible to obtain the desired shape of the contact surface in one working cycle.

The bead is disposed radially outside the area in which the attachment nut abuts against the contact section of the cable lug. In this way, the contact section is biased like a Belleville spring when the attachment nut forces the bead of the contact section against the counter surface.

The diameter of the bead and the radius of curvature of the contact surface can be chosen as a function of the respective demands. When the diameter of the bead is enlarged, the current density is reduced and the contact surface is increased in the contact area. The radius of curvature of the contact surface has to be adjusted with respect to the contact pressure which is required for the corresponding materials with the pressure force each given by the attachment nut.

What is claimed is:

1. A cable lug comprising a receiving section (12) for a cable and an attachment nut (16), characterized in that a contact section (14) is provided which is equipped with a bead (18) which can be forced by means of the attachment nut (16) against a counter surface to be contacted, further characterized in that the bead (18) is annular and concentric with the center axis of the attachment nut.

2. The cable lug according to claim 1, characterized in that the bead (18) has a contact surface (20) facing the counter surface to be contacted, which contact surface extends in a curved manner in a cross-section along a plane containing the center axis of the attachment nut (16).

3. The cable lug according to claim 1, characterized in that the contact section (14) and the receiving section (12) are designed integrally.

4. The cable lug according to claim 3, characterized in that the attachment nut (16) is captively mounted on the contact section.

5. The cable lug according to claim 3, characterized in that the bead (18) is disposed radially outside the area within which the attachment nut (16) abuts against the contact section.

6. The cable lug according to claim 3, characterized in that the bead (18) is formed by an embossing of the contact section (14) on its side facing away from the counter surface.

* * * * *